US005395145A

United States Patent [19]

Allenbaugh

[11] Patent Number: 5,395,145

[45] Date of Patent: Mar. 7, 1995

[54] LATCH GUARD FOR INWARDLY OPENING DOORS

[75] Inventor: Howard M. Allenbaugh, Huntington Beach, Calif.

[73] Assignee: M.A.G. Eng. & Mfg. Inc., Huntington Beach, Calif.

[21] Appl. No.: 54,875

[22] Filed: Apr. 28, 1993

[51] Int. Cl.[6] ..... E05B 17/00

[52] U.S. Cl. ..... 292/346; 292/340

[58] Field of Search ..... 292/300, 346, 17, 340, 292/DIG. 41

[56] References Cited

U.S. PATENT DOCUMENTS

| | | | |
|---|---|---|---|
| 3,247,924 | 4/1966 | Price | 292/DIG. 41 X |
| 3,290,081 | 12/1966 | Sushan . | |
| 3,405,962 | 10/1968 | Sushan . | |
| 3,592,498 | 7/1971 | Raccuglia, Sr. | 292/346 X |
| 3,734,551 | 5/1973 | Hughes et al. | 292/17 |
| 3,970,340 | 7/1976 | Taft | 292/300 |
| 4,130,311 | 12/1978 | Sushan . | |
| 4,547,009 | 10/1985 | Allan | 292/340 |
| 4,861,082 | 8/1989 | Priola et al. | 292/340 X |

OTHER PUBLICATIONS

"The Interlock," pp. 1–2 plus photocopy, date: unknown, Packaging and product by Don-Jo Mfg. Inc.

Latch Guard with Exposed Screws, one photo, device by MAG.

"Sentry's Lock Blocker LG-2," pp. 1–2, date: unknown, Packaging by Sentry Door Lock Guards, Inc.

*Primary Examiner*—Rodney M. Lindsey

*Attorney, Agent, or Firm*—Pretty, Schroeder, Brueggemann & Clark

[57] ABSTRACT

An interlocking latch guard for obstructing and resisting the unauthorized opening of an inwardly opening locked door comprises a frame channel mountable on the outside surface of a door frame, and a door channel mountable on the outside surface of a door. The frame channel has a pair of spaced-apart, parallel side flanges, and a front flange directed perpendicularly to the side flanges such that the frame channel has a generally U-shaped cross-section. The door channel includes at least one interlocking flange, and a back flange directed perpendicularly to the interlocking flange. When the door is closed and locked, and the channels are appropriately mounted by fasteners, the interlocking flange of the door channel protrudes substantially parallel to and in between the side flanges of the frame channel, thereby restricting or blocking access to the fasteners. In this configuration, the interlocking latch guard protects the latch from being tampered with by the use of tools, such as jimmy bars, flexible strips, or devices used to spread the door frame to disengage the latch from the frame.

8 Claims, 2 Drawing Sheets

FIG. 1
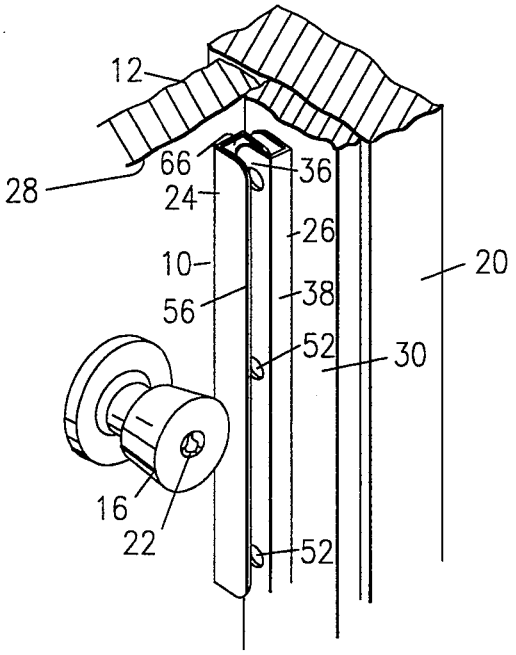
FIG. 2
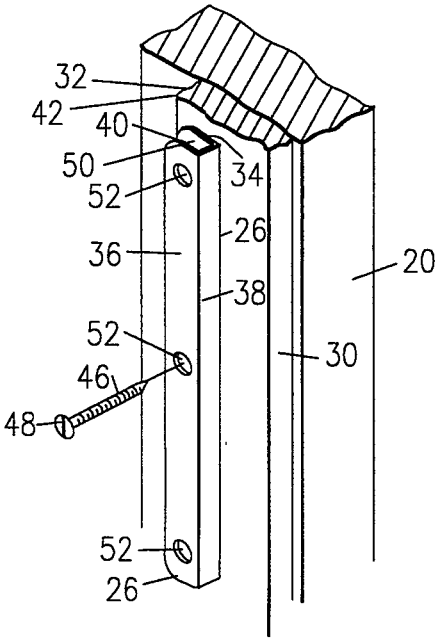
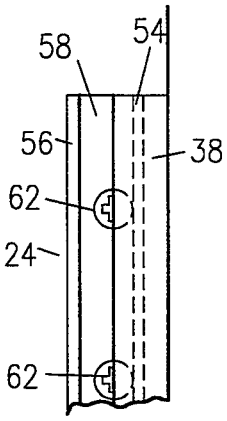
FIG. 5
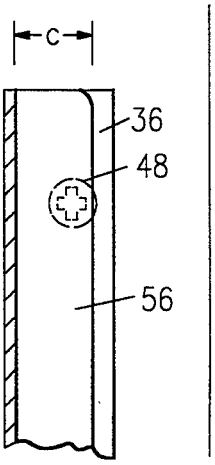
FIG. 6
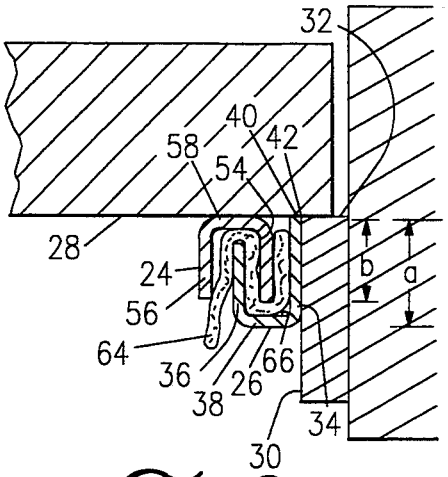
FIG. 3

LATCH GUARD FOR INWARDLY OPENING DOORS

BACKGROUND OF THE INVENTION

The present invention relates to latch guards for doors and, more particularly, to an interlocking latch guard for obstructing and resisting the unauthorized entry of an inwardly opening locked door.

Conventional door locking mechanisms typically utilize a retractable spring-loaded latch operated by a door knob rotatable from either side of the door. When the door is closed, the latch contacts a latch strike plate causing it to recede within the door until it is aligned with a socket formed within the door jamb or frame. Once aligned, the latch springs into the socket to retain the door in the closed position. The knob typically has a buttom-type locking mechanism on one side which when engaged, prevents the knob from being rotated to retract and disengage the latch from the socket. Hence, the door is locked and cannot be opened. The opposite side of the knob typically has a key mechanism for disengaging the locking mechanism so that the knob can again be rotated to retract the latch from the socket.

Unfortunately, many door locking mechanisms can be violated by techniques commonly used by unwanted intruders. For instance, many latches can be tampered with simply by sliding a flexible strip of material, such as a plastic credit card, between the door and the frame to disengage the latch from the socket, thereby allowing the door to be opened even though the knob is incapable of being rotated. More destructive methods of tampering with the latch include inserting rigid objects, such as jimmy bars or screwdrivers, between the door and the frame to pry the latch from the frame.

The more determined intruder is willing to structurally damage the door or frame to gain unauthorized entry. In this respect, the typical method of entry involves spreading the vertical frames of the door jamb at the level near the latch. The frame of a typical door is constructed of pine wood approximately one inch in width and spaced from a support stud. The latch typically extends into the frame by only one-quarter to one-half of an inch. Thus, the frame itself is not very strong and can be bent or moved fairly easily by these amounts to disengage the latch from the frame. In order to spread the frame, intruders commonly use a car-jack type device positioned horizontally between the vertical frames of the door jamb near the level of the latch. When the jack is cranked, it spreads the vertical frames such that the latch can be removed from the socket and the door opened.

To combat the above-identified problems, so-called latch guards or protectors have been developed. One example of such a device is described in U.S. Pat. No. 3,290,081. The door locking guard illustrated and described in that patent includes a latch plate attached to the door and having an extension protruding beyond the edge of the door. When the door is closed, the extension fits within a groove or channel formed in the door jamb. The channel is formed in a combined guard and latch strike plate recessed in the door stop and jamb. Therefore, one significant drawback with this type of latch guard is that it requires that the door jamb be specially cut or recessed to receive the latch strike plate, and that the door stop be rabbeted to receive the channel portion of the latch strike plate. Also, the door must be cut or recessed to attach the extension member.

A similar type of latch guard is shown in U.S. Pat. No. 4,130,311. However, this latch guard also requires that a recess be cut in the door and jamb, or that the entire jamb be made of metal that has been specially configured to form a recessed groove therein.

Another type of prior art latch guard includes a channel attached to the door which engages or interlocks with a plate attached to the door frame. Although this type of latch guard does not require that the door or frame be specially recessed or cut, it has significant additional drawbacks. For instance, the fasteners used to attach the latch guard are sufficiently exposed, even when the door is closed, to allow an intruder with a screwdriver or pliers access to remove the fasteners and hence remove the latch guard. Even if one-way screws are used, they are often susceptible to being removed with pliers or a similar tool. Further, the prior art latch guards of this type position the frame plate fasteners at a significant distance from the door and the interlocking channel. This is a significant drawback since any spreading action applied to the latch guard will be at an angle to the horizontal line of direction of the frame plate fasteners. This causes a greater torque force to be applied to the frame fasteners which is often sufficient to twist or separate them from the frame. Further, the farther the fasteners are placed from the door, the less resistant the latch guard is to the application of a spreading force.

Accordingly, there exists a definite need for a latch guard which is easy to install on the outside surfaces of a door and frame, works on most conventional doors, does not require a specially recessed door or frame or the special cutting of the door or frame, restricts access to the fasteners when the door is locked, minimizes the amount of torque placed on the fasteners when a spreading force is applied to the frame, and which is further resistant to other techniques for forcing latches open. The present invention satisfies these needs and provides further related advantages.

SUMMARY OF THE INVENTION

The present invention provides an interlocking latch guard which is resistant to various techniques commonly used by intruders to gain unauthorized entry to an inwardly opening locked door. The interlocking latch guard of the present invention comprises a door channel mountable on the outside surface of a door, and a frame channel mountable on the outside surface of a door frame. The door channel has a back flange with at least one fastener hole therethrough for receiving a fastener to mount the door channel to the door in the area of the latch. The door channel also has at least one interlocking flange oriented perpendicularly to the back flange. The frame channel has a first side flange and a second side flange which are spaced-apart and parallel to one another. The side flanges are oriented perpendicularly to a front flange such that the frame channel has a generally U-shaped cross-section. The first side flange of the frame channel has at least one fastener hole therethrough for receiving a fastener for mounting the frame channel to the door frame in the area of the latch.

The frame channel is vertically mountable along its first side flange to the door frame such that the first and second side flanges are oriented perpendicularly to the closed door. The door channel is mountable vertically along its back flange to the outside surface of the door such that the interlocking flange of the door channel is also oriented perpendicularly to the door. When the channels are properly mounted, the interlocking flange of the door channel will protrude substantially parallel to an in between the first and second side flanges of the frame channel. The interlocking flange protrudes between the side flanges to a distance sufficient to substantially block access to the frame fasteners from both a horizontal and vertical direction.

In an additional aspect of the present invention, the second side flange of the frame channel has at least one access hole therethrough corresponding to a fastener hole in the first side flange such that the corresponding holes are substantially aligned with one another. Further, the access holes in the second side flange are larger in diameter than the heads of the frame channel fasteners, such that the fasteners can pass completely through the access holes and be received in the corresponding fastener holes for mounting the frame channel to the door frame.

In another aspect of the invention, the inner width of the first side flange of the frame channel is greater than the outer width of the interlocking flange of the door channel, and the inner width of the interlocking flange is substantially equal to the inner width of the second side flange of the door channel. Accordingly, when the outer edge of the frame channel is vertically aligned with the inner edge of the door stop (nearest the door), the relative widths of the flanges will prevent the channels from abutting against one another when the door is closed.

The interlocking latch guard of the present invention prevents the latch from being tampered with since access to the latch between the door and frame is completely blocked. Thus, the latch guard prevents credit cards and the like from being inserted between the edge of the door and the door frame and also prevents the door frames from being spread apart to disengage the latch and allow the door to be opened. Moreover, the latch guard is configured such that when the door is closed and locked, access to the fasteners used to secure the latch guard to both the door and frame is effectively restricted or blocked.

The interlocking latch guard of the present invention is particularly effective against devices used to "spread" or "bow" the vertical frames of the door jamb in order to disengage the latch from the socket. In particular, intruders often wedge car-jack type devices horizontally between the vertical frames of the door jamb. When the jack is cranked, it spreads the vertical frames such that the latch can be disengaged from the socket and the door opened even though the knob cannot be rotated. The present invention is particularly effective against this method of intrusion since, unlike many of the prior art devices, the spreading force is applied normal or perpendicularly to the flanges of the latch guard and along the same line of direction as the frame channel fasteners, thereby eliminating or minimizing the amount of torque applied to the frame fasteners. Further, although the spreading force is applied generally perpendicularly to the line of direction of the door channel fasteners, the force is applied at a point very near the fasteners such that the force does not provide sufficient torque or have enough lever to twist or separate the fasteners from the door. These features are advantageous as compared to prior art devices wherein the spreading force is either not applied along the same line of direction as the fasteners (i.e., at an angle to the fasteners), or is applied at a substantial distance from the fasteners such that there is sufficient torque to twist or dislocate the fasteners from the frame or door.

The present invention is also further advantageous in that it is easy to install, works on most conventional type doors, does not require a special door frame or stop, does not require that the door or frame be specially cut or recessed for installation purposes, restricts or blocks access to the fasteners when the door is locked, and is effectively resistant to spreading forces and other methods of unauthorized intrusion.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view of an interlocking latch guard embodying the novel features of the present invention;

FIG. 2 is a perspective view showing a frame channel of the latch guard positioned against a door stop;

FIG. 3 is a cross-sectional elevational view of the latch guard, showing the use of a centering strip to properly align the door and frame channels with respect to one another;

FIG. 5 is an elevational view of a portion of the latch guard taken substantially along line 5—5 of FIG. 4; and FIG. 6 i.s an elevational view of a portion of the latch guard taken substantially along line 6—6 of FIG. 4.

DETAILED DESCRIPTION OF THE PREFERRED EMBODIMENT

Figure 4:
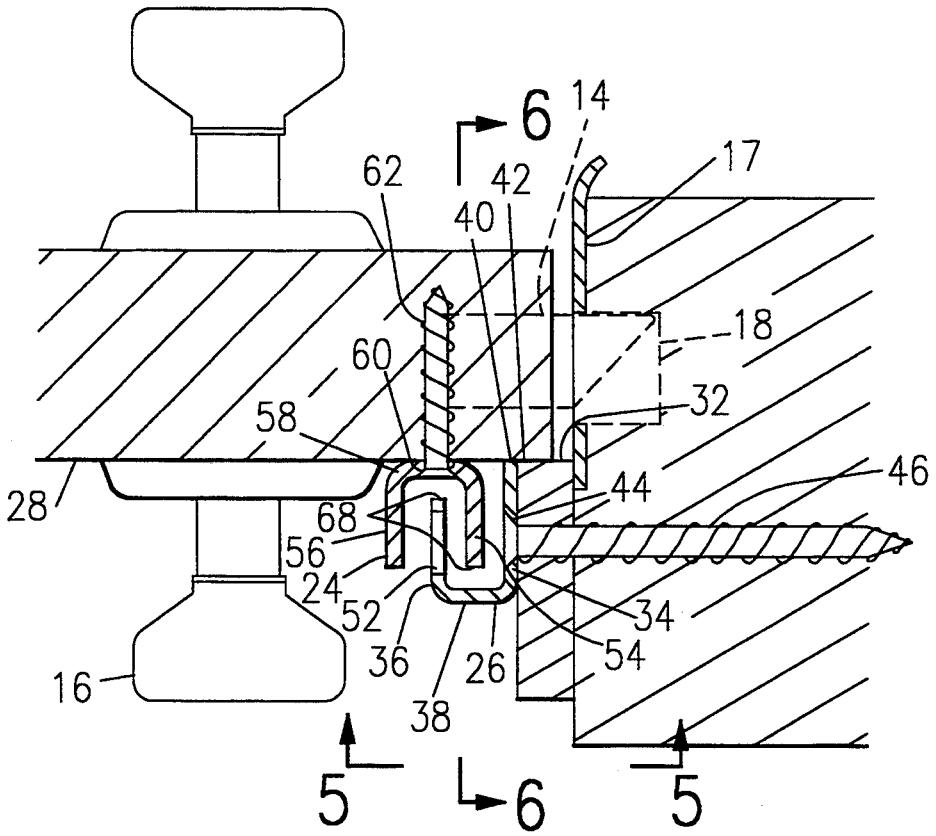
FIG. 4 is a cross-sectional plan view of the latch guard mounted to secure a closed, inwardly opening door.

As shown in the exemplary drawings, the present invention is embodied in an interlocking latch guard, generally referred to by the reference numeral 10, for guarding the latch and resisting the unauthorized opening of a locked door 12 and, more particularly, an inwardly opening locked door.

Conventional door locking mechanisms typically utilize a retractable spring-loaded latch 14 operated by a door knob 16 rotatable from either side of the door 12. When the door 12 is closed, the latch 14 contacts a latch strike plate 17 causing the latch to recede within the door until it is aligned with a socket 18 formed within a door jamb or frame 20. Once aligned, the latch 14 springs into the socket 18 to retain the door 12 in the closed position. (FIG. 4). The knob 16 typically has a buttom-type locking mechanism (not shown) on one side which when engaged, prevents the knob from being rotated to disengage the latch 14 from the socket 18. Hence, the door 12 is locked and cannot be opened. The other side of the knob 16 typically has a key mechanism 22 to disengage the door's locking mechanism such that the knob can again be rotated to retract the latch 14 from the socket 18.

As generally shown in FIG. 1, the interlocking latch guard 10 includes a door channel 24 and a door jamb or frame channel 26. The door channel 24 is shown attached or mounted to the outside surface 28 of the door 12, near the edge of the door closest to the latch 14. The frame channel 26 is shown attached to the outside surface of the door frame 20 or, more particularly, to the outside surface of a door stop 30 which is typically connected to or integral with the door frame. The inner surface 32 of the door stop 30 abuts the outside surface 28 of the door 12 when the door is closed, thereby preventing the door from opening outwardly. The door and frame channels 24 and 26 are specially configured and are attachable to the door 12 and door stop 30, respectively, in such a way that when the door is closed and locked, the channels interlock to protect the latch 14 from unwanted tampering by intruders to gain unauthorized entry.

Referring to FIGS. 1–4, the frame channel 26 is comprised of a first side flange 34 and a second side flange 36, which are spaced-apart and parallel to one another. The frame channel 26 further includes a front flange 38 which is perpendicular to and connected integrally with the first and second side flanges 34 and 36, such that the frame channel has a generally U-shaped cross-section as shown in the drawings. The channels 24 and 26 are preferably made of solid steel, and can have a brass or chrome finish for aesthetic appearance.

To install the interlocking latch guard 10, the outer edge 40 of the first side flange 34 of the frame channel 26 is vertically aligned along the inner edge 42 of the door stop 30 nearest the door 12, such that the first and second side flanges 34 and 36 are oriented perpendicularly to the closed door. Preferably, the latch guard 10 is centered with respect to the latch 14 to minimize access to the latch from above and below by tools, such as jimmy bars and flexible strips, inserted between the door 12 and frame 20. In this respect, it has been found that a frame channel 26 approximately seven inches in length and centered with respect to the latch 14 is generally suitable to achieve the objectives of the present invention.

In order to attach the frame channel 26 to the door stop 30, the first side flange 34 of the frame channel has at least one fastener hole 44, and preferably a plurality of fastener holes, extending therethrough for receiving fasteners 46. Fasteners suitable for attaching the frame channel 26 to the door stop 30 include regular hardened metal screws, and preferably, hardened metal Phillips-head screws. Most preferably, hardened metal Phillips-head screws approximately three inches in length are used to mount the frame channel 26 to the door stop 30. For this type of fastener, a one-eighth inch diameter hole is first drilled two inches deep into the door frame 20 (through the door stop 30). The fastener 46 is then inserted into the fastener hole 44 of the first side flange 34 and installed. The head 48 of the fastener 46 is larger than the diameter of the fastener hole 44 such that the head bears against the inner surface 50 of the first side flange 34 to securely fasten the frame channel 26 to the door stop 30.

In a further aspect of the present invention, the second side flange 36 of the frame channel 26 has at least one access hole 52 extending therethrough which corresponds to a fastener hole 44 in the first side flange 34. The access hole 52 in the second side flange 36 is greater in diameter than the diameter of the head 48 of the frame fastener 46. In this way, the fastener 46 can pass completely through the access hole 52 in the second side flange 36 to be received in the corresponding fastener hole 44 in the first side flange 34. The corresponding fastener and access holes 44 and 52 of the first and second side flanges 34 and 36, respectively, are preferably concentrically aligned with one another such that the fasteners 46 can be installed generally in the line of direction along the horizontal axis common to the corresponding holes.

Once the frame channel 26 has been securely fastened as discussed above, the door channel 24 is then attached to the door 12 in relation to the frame channel. Referring to FIGS. 1–4 in particular, the door channel 24 is comprised of at least one interlocking flange 54, referred to as a first interlocking flange. The door channel 24 preferably includes a second interlocking flange 56 which is parallel to and spaced-apart from the first interlocking flange 54. The door channel 24 also includes a back flange 58 which is perpendicular and integrally connected to the first and second interlocking flanges 54 and 56 such that the door channel has a generally U-shaped cross-section as shown in the drawings. The back flange 58 of the door channel 24 has at least one fastener hole 60, and preferably a plurality of fastener holes, extending therethrough for receiving fasteners 62 for attaching the door channel 24 to the door 12.

Before the door channel 24 is mounted on the outside surface 28 of the door 12, it must be properly aligned with respect to the frame channel 26 so that the channels will interlock with one another, as will be discussed below in further detail. In order to properly align the channels 24 and 26 in this respect, a centering strip 64 is partially folded in the form of a U-shape and positioned inside the frame channel 26 as shown in FIG. 3. Preferably, a centering strip 64 is placed in this manner at both the top and bottom of the frame channel 26. The centering strip 64 can be made of any suitable flexible material, such as foam or rubber. The first interlocking flange 54 of the door channel 24 is then placed vertically between the portions of the centering strip 64 inside the frame channel 26, with the top and bottom of the channels being substantially horizontally even with one another. The door 12 is then closed and the positions of the top and side of the door channel 24 are marked with a pencil or other suitable means on the door. The door 12 is then opened and the door channel 24 is appropriately placed on the marks on the door. The centers of the fastener holes 60 through the back flange 58 are marked on the door 12 for drilling holes in the door and installing the fasteners 62.

Suitable fasteners 62 for securing the door channel 24 in this manner include regular hardened metal screws, and preferably hardened metal Phillips-head screws approximately one and one-fourth inches in length for conventionally sized doors. To install the fasteners 62 into the door 12, a one-eight inch diameter hole should first be drilled one inch deep into the door (paying particular caution not to drill through the door.) The door fasteners 62 can then be placed through the appropriate door channel fastener holes 60 and installed into the drilled holes in the usual manner.

Once the door and frame channels 24 and 26 have been properly installed as described above, the first interlocking flange 54 of the door channel will protrude substantially parallel to and in between the first and second side flanges 34 and 36 of the frame channel when the door 12 is closed. Accordingly, in this configuration, the front flange 38 and second side flange 36 of the frame channel 26 substantially or completely blocks or restricts access to the door fasteners 62 used to secure the door channel 24 to the door 12. Likewise, the first interlocking flange 54, and second interlocking flange 56 if present, of the door channel 24 substantially or completely blocks or restricts access to the frame fasteners 46 used to secure the frame channel 26 to the frame 20. Thus, unlike some prior art latch guards which have exposed fasteners, the latch guard 10 of the present invention blocks or restricts access to the fasteners 46 and 62 when the door 12 is closed and locked. Thus, an intruder cannot remove the fasteners 46 and 62 with typical means, such as screwdrivers or pliers, in order to detach the latch guard 10 and eliminate its usefulness.

In a further aspect of the present invention, the inner width (distance "a," FIG. 3) of the first side flange 34 of the frame channel 26 is greater than the outer width (distance "b," FIG. 3) of the first interlocking flange 54 of the door channel 24, and the inner width (distance "c," FIG. 6) of the first interlocking flange 54 of the door channel 24 is substantially equal to the inner width (distance "b," FIG. 3) of the second side flange 36 of the frame channel 26. It will be appreciated that the widths of the flanges 34, 36 and 54 in this regard is used to define the amount of space inside the channels 24 and 26 as measured along any perpendicular line from the inside surfaces 66 of either the back flange 58 or front flange 38 to a point along a line perpendicular to either the outside edge 68 of the second side flange 36 or first interlocking flange 54. When the outer edge 40 of the first side flange 34 of the frame channel 26 is vertically aligned with the inner edge 42 of the door stop 30 (nearest the door 12), the relative widths of the flanges 34, 36 and 54 as discussed above will prevent the channels 24 and 26 from abutting against one another when the door 12 is closed. Preferably, the outer width of the first side flange 34 is approximately three-fourths of an inch and its inner width is approximately five-eighths of an inch, while the inner widths of the second side flange 36 and first interlocking flange 54 are approximately fifteen-sixteenths (15/16) of an inch, and their outer widths are approximately seventeen-thirty-seconds (17/32) of an inch.

Thus, it will be appreciated that the channels 24 and 26 of the latch guard 10 interlock to effectively obstruct access to the door latch 14, thereby restricting the use of special tools, such as flexible strips and jimmy bars, by an intruder to move the latch partially or completely out of the door socket 18 in order to unlock the door 12. More particularly, the latch guard 10 of the present invention blocks access by a flexible strip, such as a credit card, from being inserted between the door 12 and frame 20 near the latch 14 in order to disengage the latch from the socket 18. Also, the interlocking latch guard 10 of the present invention is effectively resistant to the use of jimmy bars or screwdrivers to pry between the door 12 and frame 20 near the latch 14 to disengage it from the socket 18. Since the latch guard 10 is substantially centered with respect to the latch 14, the jimmy bar must be placed substantially above or below the latch (i.e., away from the latch guard) which makes it substantially ineffective to separate the door 12 and frame 20 to disengage the latch 14 from the socket 18.

Further, intruders often wedge spreading devices (such as car-jacks) horizontally between the vertical frames 20 of a door jamb. When the jack is cranked, it spreads the frames 20 in opposite directions, thereby causing the latch 14 to disengage from the socket 18. The interlocking locking latch guard 10 of the present invention is resistant to this technique. More particularly, the interlocking latch guard 10 resists this method of intrusion since the spreading force on the frames 20 causes the channels 24 and 26 to move in opposite directions. Consequently, the second side flange 36 of the frame channel 26 will abut and oppose the force of the first interlocking flange 54 of the door channel 24 moving in the opposite direction, thereby preventing any significant separation of the latch 14 from the socket 18 (or frame 20). Importantly, since the first interlocking flange 54 substantially or completely covers the frame fastener hole 44 and frame fastener 46 from a horizontal direction, it should be appreciated that the resulting force applied to the abutting side flanges 34 and 36 is in the line of direction of the fasteners 46 used to secure the frame channel 26 to the frame 20. In other words, the spreading force applied is not at an angle with respect to the frame fasteners 46, but rather pulls directly against the fasteners along the horizontal line in which they are installed into the door frame 20. Accordingly, the torque placed on the frame fasteners 46 is either eliminated or substantially lessened, which in turn greatly reduces the likelihood that the fasteners will be twisted or separated from the frame 20, as is often the case with some prior art devices.

Furthermore, and importantly in this regard, the fasteners 46 and 62 for the frame channel 26 and door channel 24 are positioned sufficiently close to the door 12 and door stop 30, respectively, which one of ordinary skill in the art should appreciate greatly reduces or eliminates the amount of torque or lever force applied to the fasteners as a result of any spreading force applied to the channels. This further substantially eliminates or reduces the likelihood that the fasteners 46 and 62 (and latch guard 10) will be separated from the frame 20 and door 12. In addition, although the spreading force applied to the door fasteners 62 is generally perpendicular to the horizontal line of direction in which these fasteners are installed, the force is applied at a point very near the fasteners such that the force cannot provide sufficient torque or lever to twist or separate them from the door 12.

Thus, the latch guard 10 has many advantages over the other prior art devices in that it can be easily installed on the outside surfaces of the door 12 and frame 20 without cutting into the door or frame, does not require the use of specially configured doors or frames, can use typical fasteners or screws, can be used on most conventional doors and frames, restricts access to the fasteners 46 and 62 used to secure the channels 24 and 26 once the door is locked, and is effectively resistant from being forced from the door or frame upon the application of a spreading force.

While a particular form of the invention has been illustrated and described, it will be apparent that various modifications can be made without departing from the spirit and scope of the invention. Accordingly, it is not intended that the invention be limited, except as by the appended claims.

I claim:

1. A latch guard attachable to a door and a door frame for obstructing and resisting unauthorized entry to an inwardly opening, locked door, comprising:

a frame channel having a first side flange and a second side flange parallel to the first side flange, and a front flange perpendicular to the first and second side flanges such that the channel has a generally U-shaped cross-section, the first side flange having at least one fastener hole therethrough for receiving a fastener for attaching the frame channel to the door frame;

a door channel having a first interlocking flange, a second interlocking flange spaced-apart and parallel to the first interlocking flange, and a back flange perpendicular to the interlocking flanges such that the door channel has a generally U-shaped cross-section, the back flange of the door channel having at least one fastener hole therethrough for receiving a fastener for attaching the door channel to the door, wherein the door channel and frame channel are respectively attachable to the outside surface of the door and frame such that when the door is closed the first interlocking flange of the door channel will protrude substantially parallel to and in between the first and second side flanges of the frame channel and the second side flange of the frame channel is positioned substantially parallel to and in between the first and second interlocking flanges of the door channel to block access to the fasteners of the door channel; and means for centering the position of the first interlocking flange of the door channel between the first and second flanges of the frame channel, wherein the centering means comprises a flexible centering strip of material adapted to be positioned within the frame channel and to substantially conform to the U-shape of the first frame channel, and wherein the centering strip spaces the first interlocking flange of the door channel by substantially equal distances from the first and second flanges and the front flange of the frame channel.

2. The latch guard of claim 1, wherein the frame channel is attachable vertically to the outside surface of the door frame such that the first and second side flanges are oriented perpendicularly to the door when closed, and the door channel has attachable vertically to the outside surface of the door such that the first and second interlocking flanges are oriented perpendicularly to the door.

3. The latch guard of claim 1, wherein the second side flange of the frame channel has at least one access hole therethrough corresponding to a fastener hole in the first side flange.

4. The latch guard of claim 1, wherein the channels are attachable such that the first interlocking flange protrudes between the first and second side flanges of the frame channel to substantially block access to the frame fasteners.

5. The latch guard of the claim 1, further comprising fastener means for attaching the frame and door channels respectively to the frame and door.

6. The latch guard of claim 5, wherein the fastener means comprise hardened metal Phillips-head screws.

7. A latch guard attachable to a door and a door frame for obstructing and resisting unauthorized entry to an inwardly opening, locked door, comprising:

a frame channel having a first side flange and a second side flange parallel to the first side flange, and a front flange perpendicular to the first and second side flanges such that the channel has a generally U-shaped cross-section, the first side flange having at least one fastener hole therethrough for receiving a fastener for attaching the frame channel to the door frame;

a door channel having at least one interlocking flange and a back flange perpendicular to the interlocking flange, the back flange of the door channel having at least one fastener hole therethrough for receiving a fastener for attaching the door channel to the door, wherein the door channel and frame channel are respectively attachable to the outside surface of the door and frame such that when the door is closed the interlocking flange of the door channel will protrude substantially parallel to and in between the first and second side flanges of the frame channel; and centering means for centering the position of the first interlocking flange between the first and second side flanges of the frame channel, the centering means including a flexible centering strip of material adapted to be positioned within the frame channel and to substantially conform to the U-shape of the frame channel, and wherein the centering strip spaces the interlocking flange by substantially equal distances from the first and second side flanges and the front flange of the frame channel.

8. A latch guard for protecting the latch of an inwardly opening door, comprising:

a frame channel having a first side flange and a second side flange substantially parallel to the first side flange, and a front flange substantially perpendicular to the first and second side flanges such that the frame channel has a generally U-shaped cross-section, the first side flange having fastener holes for receiving fasteners for mounting the frame channel to a door frame, and the second side flange having an access hole concentrically aligned with a corresponding fastener hole to enable installation and removal of the fasteners, wherein the frame channel is adapted to be mounted in a vertical orientation to a door frame such that the first and second flanges are substantially perpendicular to the outside surface of the door when closed;

a door channel having a first interlocking flange and a second interlocking flange substantially parallel to the first interlocking flange, and a back flange substantially perpendicular to the first and second interlocking flanges such that the door channel has a generally U-shaped cross-section, the back flange having fastener holes for receiving fasteners for mounting the door channel in a vertical orientation to the outside surface of the door, such that the first interlocking flange extends substantially parallel to and in between the first and second side flanges of the frame channel when the door is closed and blocks access to the fasteners of the frame channel, and such that the second side flange of the frame channel extends substantially parallel to and in between the first and second interlocking flanges of the door channel when the door is closed and blocks access to the fasteners of the door channel; and a flexible centering strip of material adapted to be positioned within the frame channel and to substantially conform to the U-shape of the frame channel, and wherein the centering strip spaces the first interlocking flange by substantially equal distances from the first and second side flanges and the front flange of the frame channel and spaces the second side flange by substantially equal distance from the first and second interlocking flanges and the back flange.

* * * * *